US009598950B2

(12) United States Patent
Frosell

(10) Patent No.: US 9,598,950 B2
(45) Date of Patent: Mar. 21, 2017

(54) SYSTEMS AND METHODS FOR MONITORING WELLBORE VIBRATIONS AT THE SURFACE

(71) Applicant: Halliburton Energy Services, Inc., Houston, TX (US)

(72) Inventor: Thomas Jules Frosell, Irving, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 385 days.

(21) Appl. No.: 14/371,244

(22) PCT Filed: Jun. 12, 2013

(86) PCT No.: PCT/US2013/045294

§ 371 (c)(1),
(2) Date: Jul. 9, 2014

(87) PCT Pub. No.: WO2014/200467

PCT Pub. Date: Dec. 18, 2014

(65) Prior Publication Data

US 2015/0240619 A1 Aug. 27, 2015

(51) Int. Cl.

| | |
|---|---|
| ***E21B 47/00*** | (2012.01) |
| ***E21B 47/09*** | (2012.01) |
| ***E21B 33/03*** | (2006.01) |
| ***E21B 33/12*** | (2006.01) |
| ***E21B 34/06*** | (2006.01) |

(52) U.S. Cl.

CPC ..... *E21B 47/00* (2013.01); *E21B 33/03* (2013.01); *E21B 33/12* (2013.01); *E21B 34/06* (2013.01); *E21B 47/091* (2013.01)

(58) Field of Classification Search
None
See application file for complete search history.

(56) References Cited

U.S. PATENT DOCUMENTS 5,995,449 A * 11/1999 Green ..... E21B 23/04 340/853.3
6,065,332 A 5/2000 Dominick
6,246,962 B1 6/2001 Schultz et al.
(Continued)

FOREIGN PATENT DOCUMENTS

WO 2014200467 A1 12/2014

OTHER PUBLICATIONS

International Search Report and Written Opinion for PCT/US2013/045294 dated Mar. 12, 2014.

*Primary Examiner* — Shane Bomar
(74) *Attorney, Agent, or Firm* — McDermott Will & Emery LLP

(57) ABSTRACT

Disclosed are systems and methods of observing downhole tool operations through surface monitoring of vibrations. One system includes at least one downhole tool arranged within conveyed into a wellbore on a work string of a well and configured to facilitate at least one downhole event that generates at least one shock wave, the wellbore including a wellhead, one or more sensors arranged at or near a surface of the well the wellhead and configured to sense the one or more shock waves generated by the at least one downhole tool, and a computer system configured to receive and process sensor signals from the one or more sensors and generate a resulting output signal corresponding to the downhole event.

20 Claims, 3 Drawing Sheets

(56) References Cited

U.S. PATENT DOCUMENTS

| | | | | |
|---|---|---|---|---|
| 2002/0057211 | A1 | 5/2002 | Tubel et al. | |
| 2005/0197813 | A1 | 9/2005 | Grayson | |
| 2008/0068210 | A1 | 3/2008 | Follini et al. | |
| 2012/0006613 | A1* | 1/2012 | Tseytlin | E21B 21/08 181/106 |
| 2012/0222900 | A1 | 9/2012 | Rodney et al. | |
| 2013/0080060 | A1 | 3/2013 | Yang | |
| 2013/0118249 | A1* | 5/2013 | Conn | E21B 47/18 73/152.21 |
| 2015/0107902 | A1* | 4/2015 | Downton | E21B 7/062 175/45 |

* cited by examiner

SYSTEMS AND METHODS FOR MONITORING WELLBORE VIBRATIONS AT THE SURFACE

BACKGROUND

The present disclosure is generally related to monitoring wellbore operations and, more particularly, to observing downhole tool operations through surface monitoring of vibrations.

The oil industry has been gathering various information about well drilling for many years. Of great interest in modern petroleum drilling and production operations is information relating to the drill string and downhole tool operation. Such information may include the location of the drill string within the borehole or the status of a particular wellbore operation as undertaken by a downhole tool extended into the wellbore on a drill string or another type of tubing or conveyance. For example, it is often desired to know whether a particular downhole tool has actuated properly or otherwise operated as expected.

There are currently various methods that may be used to obtain and verify such downhole information. For example, well operators are sometimes able to ascertain whether a downhole tool has properly completed a wellbore operation by knowing the approximate depth of the tubing as extended into the wellbore (taking into account stretch and other parameters) and monitoring weight differentials in the tubing as measured at the surface. If a sliding sleeve has been properly closed, for example, the weight of the tubing as measured at the surface will register an identifiable weight change indicating the completion of such a closure. Similar weight changes may be monitored and identified at the surface for other downhole tools and wellbore operations, such as snapping a collet through a restriction, setting a packer, engaging a restriction with the tubing, etc.

Such a method, however, is not always available to provide a positive indication that the downhole tool has properly actuated or completed a wellbore operation. Rather, unless costly and time-consuming well testing is undertaken, the well operator may only assume that the downhole tool has properly actuated or completed the wellbore operation as based on measured weight differentials. Further, this weight differential method becomes unreliable in wells that reach depths of 20,000 feet or more, where the weight differential felt at the surface is reasonably insignificant as compared to the weight of the entire tubing. Measuring weight differentials at the surface in deviated or horizontal wells can also be an unreliable means of determining downhole tool activation since a good portion of the tubing weight is assumed through contact with the wellbore wall. As a result, inaccurate measurements can be rendered in deep and/or deviated wells.

SUMMARY OF THE DISCLOSURE

The present disclosure is generally related to monitoring wellbore operations and, more particularly, to observing downhole tool operations through surface monitoring of vibrations.

In one embodiment, a system is disclosed that may include at least one downhole tool arranged within a wellbore of a well and configured to facilitate at least one downhole event that generates at least one shock wave, one or more sensors arranged at or near a surface of the well and configured to sense the one or more shock waves generated by the at least one downhole tool, and a computer system configured to receive and process sensor signals from the one or more sensors and generate a resulting output signal corresponding to the downhole event.

In other embodiments, a method is disclosed that may include introducing at least one downhole tool into a wellbore of a well, facilitating at least one downhole event with the at least one downhole tool and thereby generating at least one shock wave propagating within the wellbore, sensing the at least one shock wave with one or more sensors arranged at or near a surface of the well, conveying at least one sensor signal from at least one of the one or more sensors to a computer system communicably coupled thereto, receiving and processing the at least one sensor signal with the computer system, and generating a resulting output signal corresponding to the at least one sensor signal.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure is generally related to monitoring wellbore operations and, more particularly, to observing downhole tool operations through surface monitoring of vibrations.

Disclosed are systems and methods of monitoring downhole activity or wellbore operations. Common wellbore operations occurring downhole create vibrations that oftentimes are able to resonate from the point of occurrence and up the wellbore to the surface. These vibrations propagating from the downhole environment may exhibit unique shock wave profiles corresponding to particular tools or particular downhole actions that have transpired. According to the embodiments described herein, such shock wave profiles may be monitored and/or otherwise measured using one or more sensors arranged at or near the surface. As a result, a signal processor communicably coupled to such sensors may be able to determine what downhole tool actuated or what downhole operation occurred, thereby providing a positive indication as to the downhole event. Analysis of these vibrations or shock wave profiles may also be advantageous in performing other calculations, such as determining or confirming well depth or string length.

Figure 1:
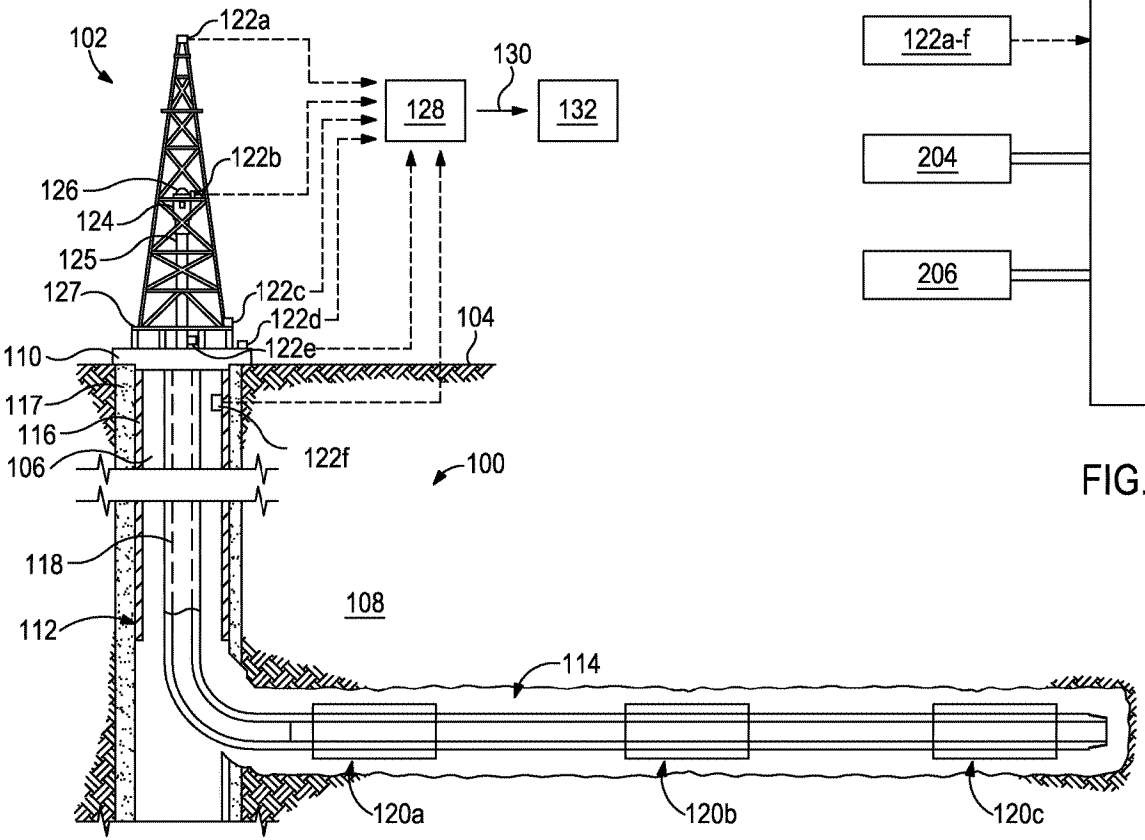
FIG. 1 illustrates an exemplary well system that may employ one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may include a service rig 102 positioned on the earth's surface 104 and extending over and around a wellbore 106 that penetrates one or more subterranean formations 108. The service rig 102 may be a drilling rig, a completion rig, a workover rig, or the like. Moreover, while the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be capped with a wellhead installation 110 including blowout prevention equipment (not shown) used to seal, control, and monitor the wellbore 106. The wellbore 106 may be drilled into the subterranean formation 108 using any suitable drilling technique and may include a vertical wellbore portion 112 that extends in a substantially vertical direction away from the earth's surface 104. At some point in the wellbore 106, the vertical wellbore portion 112 may deviate from vertical relative to the earth's surface 104 and transition into a substantially lateral wellbore portion 114.

In an embodiment, the wellbore 106 may be at least partially cased with a casing string 116 secured into position within the wellbore 106 using, for example, cement 117. In other embodiments, the casing string 116 may be only partially cemented within the wellbore 106, or, alternatively, the casing string 116 may be entirely uncemented. A work string 118 may be extended into the wellbore 106 from the service rig 102. As used herein, the term "work string" refers to one or more types of connected lengths of tubulars known in the art and may include, but is not limited to, drill pipe, drill string, landing string, completion string, wash pipe, production tubing, coiled tubing, casing, liners, combinations thereof, or the like. In sub-sea applications, "work string" may also refer to a riser or the like that extends from a subsea wellhead installation to the rig floor of a floating platform, for example.

A lower portion of the work string 118 may extend into the lateral portion 114 of the wellbore 106. As illustrated, the lateral portion 114 may be an uncased or "open hole" section of the wellbore 106. It is noted that although FIG. 1 depicts horizontal and vertical portions of the wellbore 106, the principles of the systems and methods disclosed herein may be similarly applicable to or otherwise suitable for use in wholly horizontal or vertical wellbore configurations. Consequently, the horizontal or vertical nature of the wellbore 106 should not be construed as limiting the present disclosure to any particular wellbore 106 configuration As illustrated, the system 100 may further include one or more downhole tools 120 (shown as 120*a*, 120*b*, and 120*c*) arranged in, coupled to, or otherwise forming an integral part of the work string 118. The downhole tools 120*a-c* may include a variety of tools, devices, or machines that may be used in the preparation, stimulation, and production of the subterranean formation 108. In at least one embodiment, for example, one or more of the downhole tools 120*a-c* may include or otherwise be a sliding sleeve assembly or a shifting tool used to move or actuate a sliding sleeve. In other embodiments, one or more of the downhole tools 120*a-c* may be a packer assembly or another type of wellbore isolation device. In yet other embodiments, one or more of the downhole tools 120*a-c* may be a collet assembly or another type of profiled device configured to interact with a corresponding profile defined within the wellbore 106. In even further embodiments, one or more of the downhole tools 120*a-c* may be a wellbore projectile such as, but not limited to, a ball, a dart, a wiper, a plug, etc. In yet further embodiments, one or more of the downhole tools 120*a-c* may encompass two or more of the above-identified devices. Those skilled in the art will readily appreciate that several other downhole tools not mentioned herein may be used as one of the downhole tools 120*a-c*, without departing from the scope of the disclosure.

As used herein, the term "downhole event" refers to the actuation or operation of one of the downhole tools 120*a-c*, such as a packer being set, shifters closing or opening a sliding sleeve, a collet snapping through (into and/or out of) a restriction, etc. A "downhole event" may also refer to a wellbore operation that has occurred downhole at or near one of the downhole tools 120*a-c*. For instance, a downhole event may include a profiled tool or wellbore projectile hitting a wellbore profile, restriction, or other wellbore obstruction. Additionally, it will be appreciated that a single downhole tool 120*a-c* may operate to assume or otherwise facilitate multiple downhole events.

Occurrence of such downhole events may create or otherwise generate vibrations within the wellbore 106 that may propagate toward the earth's surface 104 and surface of the wellbore 106 (i.e., the "surface of the well"). As used herein, the term "surface of the well" refers to the earth's surface 104 and any structural components of the system 100 arranged at or near the opening to the wellbore 106 such as, but not limited to, the service rig 102, the wellhead installation 110, and portions of the wellbore 106 just below the earth's surface 104. In some embodiments, such vibrations may propagate toward the surface of the well along the work string 118 or the casing string 116. In other embodiments, such vibrations may propagate toward the surface of the well within fluids present within the wellbore 106 (e.g., pressure waves transmitted through the annulus defined between the work string 118 and the inner wall of the wellbore 106).

Such propagating vibrations may be referred to herein as a "shock wave." According to the present disclosure, each downhole event may result in a unique shock wave profile that may be sensed or otherwise measured at or near the surface of the well. More particularly, the system 100 may include one or more sensors 122 (shown as sensors 122*a*, 122*b*, 122*c*, 122*d*, 122*e*, and 122*f*) located at or near the surface of the well and configured to sense or otherwise measure the shock waves originating downhole. While only six sensors 122*a-f* are depicted in FIG. 1 and discussed herein, those skilled in the art will readily appreciate that more or less than six sensors 122*a-f* may be used, without departing from the scope of the disclosure.

The sensors 122*a-f* may be any type of sensing device or apparatus configured to measure and otherwise quantify vibrations. For example, one or more of the sensors 122*a-f* may include, but are not limited to, an accelerometer, a strain gauge, a pressure transducer, a piezoelectric transducer (e.g., a hydrophone), a piezo stack sensor, or the like.

As illustrated, the sensors 122*a-f* may be arranged at several locations at or around the surface of the well. For example, a first sensor 122*a* may be arranged at the top of the service rig 102 (e.g., at the crown block). A second sensor 122*b* may be arranged on at least one component of service rig 102, such as the traveling block 124, the kelly 125, the bails 126, the elevators (not shown), or any of the rigging equipment associated with the service rig 102. It should be noted that while the second sensor 122*b* is depicted in FIG. 1 as generally mounted to the traveling block 124, such placement is meant to refer to a general attachment to any of the above-mentioned equipment related to the service rig 102.

A third sensor 122*c* may be arranged on the rig floor 127. A fourth sensor 122*d* may be arranged on the wellhead installation 110. A fifth sensor 122*e* may be arranged on or otherwise attached to a portion of the work string 118 (either interior or exterior). In some embodiments, the fifth sensor 122*e* may function outside of the wellbore 106 (i.e., above the wellhead installation 110), but in other embodiments, the fifth sensor 122*e* may be function within the wellbore 106 (i.e., downhole from the wellhead installation 110). A sixth sensor 122*f* may be arranged on or otherwise attached to the inner wall of the casing string 116. In other embodiments, the sixth sensor 122*f* may be attached to the inner or outer surfaces of a riser (not shown) extending from a submersible or semi-submersible service rig.

It should be noted that the number and location of the sensors 122*a-f* shown in FIG. 1 are not limited solely to the arrangement of FIG. 1. Rather, those skilled in the art will readily appreciate that more or less than six sensors 122*a-f* may be used in the system 100, without departing from the scope of the disclosure. Moreover, the sensors 122*a-f* may be placed at any location at or near the surface of the well that is capable of receiving the shock waves propagating from one or more of the downhole tools 120*a-c*. Accordingly, the number and placement of the sensors 122*a-f* should not be construed as limiting the present disclosure in any way.

In exemplary operation, the sensors 122*a-f* may be configured to sense vibrations or shock wave profiles propagating from the downhole environment. Each sensor 122*a-f* may be communicably coupled to a computer system 128 and configured to provide a corresponding sensor signal to the computer system 128 for processing. It should be readily apparent to those skilled in the art that each sensor 122*a-f* may be "built-in" to the computer system 128, for example, being sold as a single off-the-shelf unit or product. Alternatively, the computer system 128 may be apart from each sensor 122*a-f*. Further, each sensor 122*a-f* may be communicably coupled to one or more computer systems 128. The sensors 122*a-f* may communicate with the computer system 128 via any telecommunication methods known to those skilled in the art including, but not limited to, wired, wireless, fiber optic, combinations thereof, and the like. In some embodiments, the computer system 128 may be arranged at or near the service rig 102. In other embodiments, however, the computer system 128 may be remotely located and the sensors 122*a-f* may be configured to communicate remotely with the computer system 128 (either wired or wirelessly).

Briefly, the computer system 128 may be configured to receive and process the sensor signals and provide a resulting output signal 130 to one or more peripheral devices 132 for consideration and/or review by a well operator. The resulting output signal 130 may contain data corresponding to one or more downhole events measured or otherwise sensed by the sensors 122*a-f* and the peripheral devices 132 may be configured to inform the well operator as to whether a particular downhole event has in fact transpired in view of the acquired sensor data. The peripheral devices 132 may include, but are not limited to, a monitor (e.g., displays, GUIs, etc.), a printer, an alarm, additional storage memory, etc. In some embodiments, the monitor or the printer may be configured to provide the well operator with a graphical output corresponding to a particular downhole event. The alarm (either audible or visual) may be configured to alert the well operator that a particular downhole event has indeed transpired.

Figure 2:
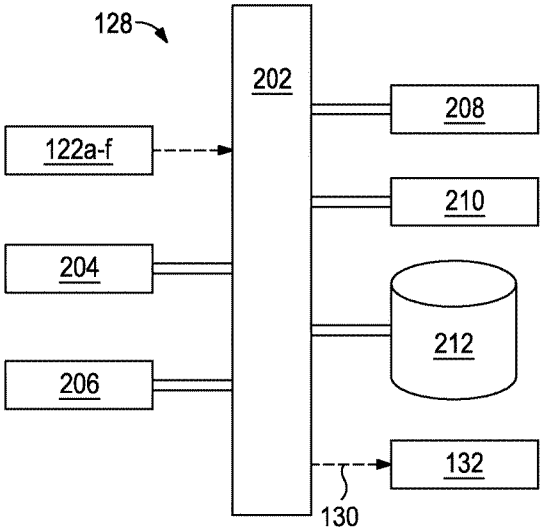
FIG. 2 illustrates an exemplary computer system, according to one or more embodiments.

Referring now to FIG. 2, with continued reference to FIG. 1, illustrated is a block diagram of the computer system 128, according to one or more embodiments. As illustrated, the system 128 may include a bus 202, a communications unit 204, one or more controllers 206, a non-transitory computer readable medium (i.e., a memory) 208, a computer program 210, and a library or database 212. The bus 202 may provide electrical conductivity and a communication pathway among the various components of the system 128. The communications unit 204 may employ wired or wireless communication technologies, or a combination thereof. The communications unit 204 can include communications operable among land locations, sea surface locations both fixed and mobile, and undersea locations both fixed and mobile. The computer program 210 may be stored partially or wholly in the memory 208 and, as generally known in the art, it may be in the form of microcode, programs, routines, or graphical programming.

In exemplary operation, the computer system 128 receives and samples one or more sensor signals derived from a corresponding one or more of the sensors 122*a-f*. The controller 206 may be configured to transfer the sensor signal to the memory 208, which may encompass at least one of volatile or non-volatile memory. The computer program 210 may be configured to access the memory 208 and process the sensor signals in real-time. In some embodiments, however, the sensor signals may be logged or otherwise stored in the memory 208 or the database 212 for post-processing review or analysis.

In processing the sensor signals, the computer program 210 may be configured to digitize the sensor signal and generate digital data. The computer program 210 may employ pre or post-acquisition processing by applying one or more signal amplifiers and/or signal filters (e.g., low, medium, and/or high-pass frequency filters) in hardware or software. In some embodiments, the computer program 210 may be configured to output the acquired signal in the time domain, thereby providing a time domain output. In another embodiment, the computer program 210 may also be capable of transforming and outputting the digital data in the frequency domain, thereby providing a frequency domain output. This transformation into the frequency domain may be accomplished using several different frequency-based processing methods including, but not limited to, fast Fourier transforms (FFTs), short-time Fourier transforms (STFTs), wavelets, the Goertzel algorithm, or any other domain conversion methods or algorithms known by those skilled in the art. In some embodiments, one or both of the time domain and frequency domain signals may be filtered using at least one of a low-pass filter, a medium-pass filter, and a high-pass filter or other types of filtering techniques, without departing from the scope of the disclosure.

The computer program 210 may further be configured to query the database 212 for stored data corresponding to one or more downhole events. In particular, the database 212 may contain a searchable library containing several pre-recorded data signals, each corresponding to a particular downhole event that may occur. One of skill in the art will appreciate that the term "pre-recorded" data signals may include, but is not limited to, actual data recorded (logged) from previous downhole operations, expected data based on industry knowledge or information, expected data produced by mathematical calculations or models, or any combination thereof. In at least one embodiment, the query may be narrowed based on the particular wellbore operation currently being performed in the system 100 (FIG. 1). Upon querying the database 212, the computer program 210 may be able to compare the acquired and processed sensor signals with the pre-recorded data signals. The computer program 210 may then output the acquired and processed signals, the pre-recorded data signals, a comparison between them, or any/all of the aforementioned to one or more of the peripheral devices 132.

As mentioned above, the peripheral devices 132 may be configured to inform a well operator as to whether a particular downhole event has transpired in view of the acquired sensor signals. In some embodiments, the peripheral devices 132 may encompass a display that can be used with instructions stored in the memory 208 or computer program 210 to implement a user interface enabling the well operator to manage the operation of the sensors 122*a-f*. Such a user interface can be operated in conjunction with the communications unit 204 and the bus 202.

Referring again to FIG. 1, with continued reference to FIG. 2, exemplary operation of the system 100 is now provided. In one embodiment, one or more of the downhole tools 122*a-c* may be a sliding sleeve assembly or a shifting tool used to move or actuate a sliding sleeve. Upon actuation of the sliding sleeve (i.e., a downhole event), a unique shock wave profile may be emitted in the wellbore 106 and propagate toward the earth's surface 104 and surface of the well. In some embodiments, the shock wave profile is transmitted through the work string 118. In other embodiments, however, the shock wave profile may be transmitted through the fluids present in the wellbore 106 in the annulus between the work string 118 and the wellbore 106, such as via fluid pressure waves. One or more of the sensors 122*a-f* may be arranged or otherwise configured to receive the generated shock wave profile and convey a corresponding sensor signal to the computer system 128 for processing.

As generally described above, the computer system 128 may be configured to query the database 212 for pre-recorded data signals corresponding to one or more downhole events that match or substantially match the recorded shock wave profile. The computer system 212 may then output 130 the acquired signals, the pre-recorded data signals, a comparison between the two, or any/all of the aforementioned to the one or more peripheral devices 132, thereby informing a well operator that a particular downhole event has transpired. As will be appreciated, this may prove advantageous in providing a well operator with a positive or negative indication as to proper or improper operation of the downhole event.

In another embodiment, one or more of the downhole tools 122*a-c* may be a packer assembly. Upon actuation of the packer assembly, another unique shock wave profile corresponding to the packer assembly may be emitted in the wellbore 106 and propagate toward the earth's surface 104 and surface of the well. Again, one or more of the sensors 122*a-f* may be arranged or otherwise configured to receive the newly generated shock wave profile and convey a corresponding sensor signal to the computer system 128 for processing. After querying the database 212 for pre-recorded data signals corresponding to a downhole event matching or substantially matching the recorded shock wave profile, the computer system 128 may then output 130 the acquired signals, the pre-recorded data signals, a comparison between the two, or any/all of the aforementioned to the one or more peripheral devices 132. As a result, the well operator may be informed as to whether the packer assembly in fact actuated as intended.

In yet another embodiment, one or more of the downhole tools 122*a-c* may be a collet assembly configured to snap through a profile, for example. Upon snapping in or out of the profile, the collet assembly may generate yet another unique shock wave profile corresponding to the collet assembly that may propagate through the wellbore 106 toward the surface of the well (either via the work string 118 or the fluids present in the wellbore 106). One or more of the sensors 122*a-f* may be arranged or otherwise configured to receive the newly generated shock wave profile and convey a corresponding sensor signal to the computer system 128 for processing. After querying the database 212 for pre-recorded data signals corresponding to a downhole event matching or substantially matching the recorded shock wave profile, the computer system 128 may then output 130 the acquired signals, the pre-recorded data signals, a comparison between the two, or any/all of the aforementioned to the one or more peripheral devices 132. As a result, the well operator may be informed as to whether the collet assembly indeed functioned as intended.

Those skilled in the art will readily appreciate that any one of the downhole tools 120*a-c* may be modified or otherwise designed to create a particular or predetermined shock wave profile when actuated or operated. This may prove advantageous when the shock wave generated by the device is not sufficient or otherwise distinct enough to be readily sensed with the sensors 122*a-f*. For instance, two or more shock wave profiles may be substantially similar, and modifying the design or configuration of the downhole tools 120*a-c* may result in the generation of larger amplitudes or a desired (tuned) frequency content enabling the computer system 128 to more easily differentiate between shock wave profiles corresponding to different tools or wellbore operations.

In another embodiment of the present disclosure, the computer system 128 may also utilize the acquired data to correlate length and location of the work string 118 at depth against surface position data. Due to compression and extreme temperatures, the depth of the work string 118 may not be equal to the surface position data. However, surface position data can be correlated and corrected (i.e., re-calibrated) by the computer program 210 to match actual work string depth by monitoring when a downhole event occurs. Additionally, or alternatively, this information may be used as one of the output signals 130 to one or more of the peripheral devices 132, such as an automated position data system.

In addition the computer program 210 may store the acquired data in the memory 208 or the database 212 for post-processing review or analysis. This may be useful to a rig operator, for example, to correlate the downhole event, such as setting a packer, with pressures or other signals being monitored at the time of the downhole event. This may also prove useful in providing well operators with a positive indication that a particular downhole event has indeed transpired as planned.

Figure 3:
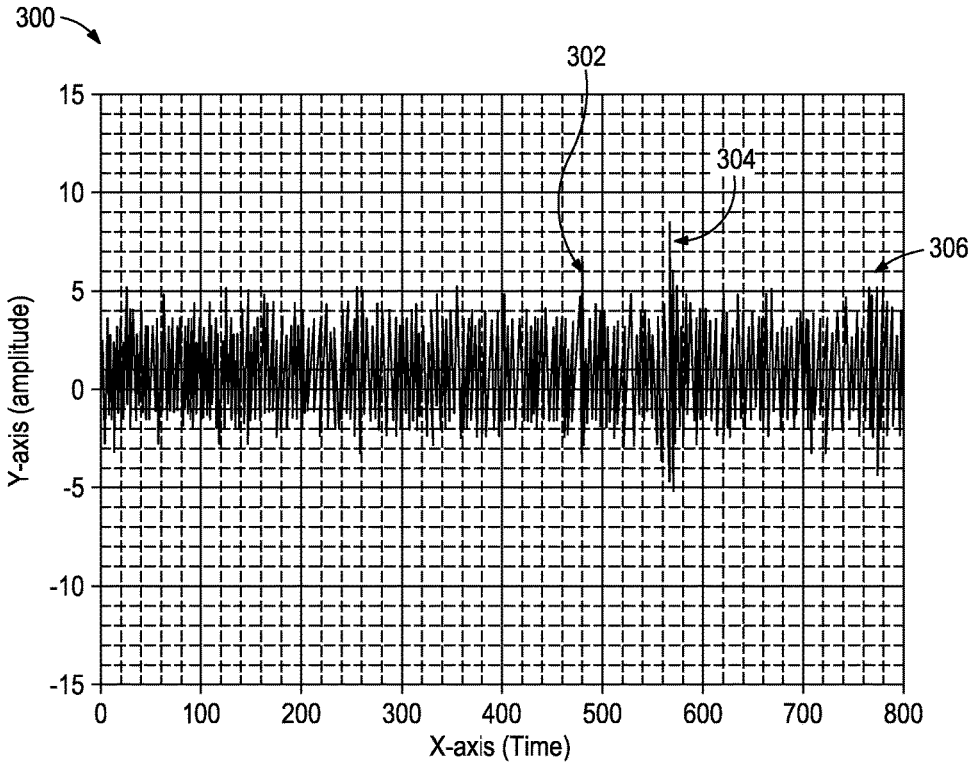
FIG. 3 illustrates a time domain plot of an acquired signal from a downhole event, according to one or more embodiments.

Referring now to FIG. 3, with continued reference to FIG. 1 and FIG. 2, illustrated is an exemplary time domain plot 300 depicting an acquired signal from an exemplary downhole event, according to one or more embodiments. More particularly, the plot 300 displays acquired data resulting from the operation of a collet assembly (e.g., snapping through a restriction) as measured at or near the surface of the well using at least one of the sensors 122*a-f*. The plot 300 is representative of at least one of the output signals 130 shown as a graphical output via one of the peripheral devices 132 (e.g., a monitor, a printer, a GUI, etc.).

As illustrated, the plot 300 depicts at least two main peaks, shown as data signals 302 and 304. The signals 302, 304 correspond to the shock wave profile generated by the collet assembly and measured at or near the surface of the well. The plot 300 further illustrates the acquired signal with information not corresponding to the downhole event, as shown at signal 306. The signal 306 is likely related to rig noise and may otherwise be disregarded by the well operator. It will be appreciated to one of skill in the art that variations of the plot 300 may implement scaling or offsets of the acquired data, without departing from the scope of the disclosure.

Since the signal 306 may not be readily discernible from the downhole events by the well operator (or the computer program 210), the signal 306 may inadvertently be interpreted or confused with the data signals 302, 304 corresponding to the true downhole event. Therefore, one of skill in the art will readily appreciate the clarity which transformation of the acquired or processed data into the frequency domain may provide in order to accurately determine which acquired signal is a result from the downhole event.

Figure 4:
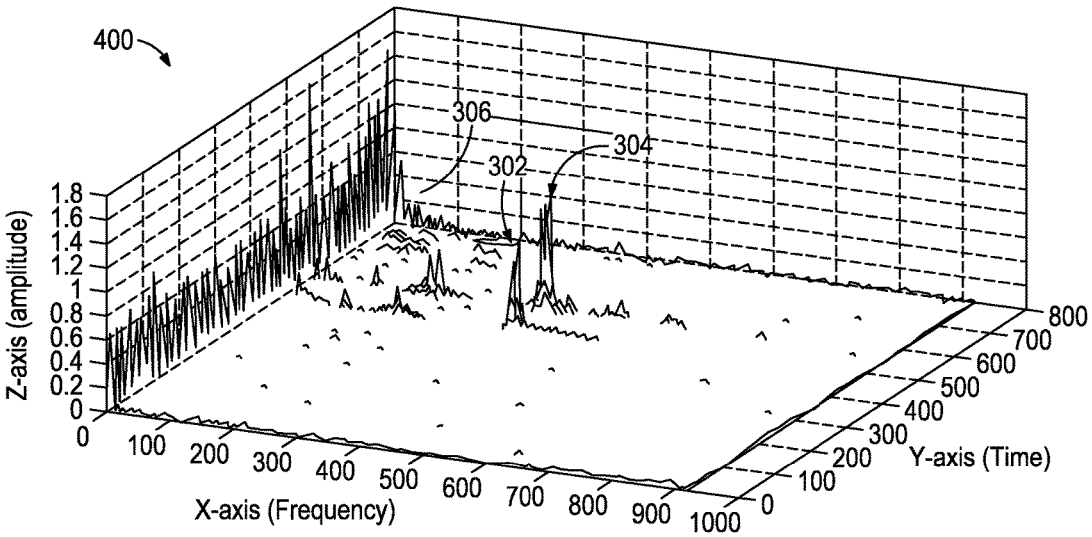
FIG. 4 illustrates a three dimensional frequency domain plot of a signal acquired from a downhole event, according to one or more embodiments.

Referring now to FIG. 4, with continued reference to FIG. 3, illustrated is a three-dimensional frequency domain plot 400 depicting an acquired signal from an exemplary downhole event, according to one or more embodiments. More particularly, the plot 400 illustrates the acquired signals 302, 304, and 306 of FIG. 3 as transformed into the frequency domain. As mentioned above, transformation from time domain to frequency domain may be accomplished using a fast Fourier transform, short-time Fourier transform, wavelet, the Goertzel algorithm, or any other methods known by those skilled in the art. In the plot 400, the X-axis represents frequency (in Hz), the Y-axis represents time, and the Z-axis represents magnitude or amplitude of the acquired signal.

When the signals 302, 304, and 306 are displayed in the frequency domain plot 400, the frequency and amplitude difference clearly sets apart the signals 302, 304 corresponding to the collet snapping through the restriction as compared to the signal 306 corresponding to rig noise. In one embodiment, a collet snapping through a restriction may be predicted to create a shock wave profile or signal at or near 400 Hz. Thus, the acquired signals 302, 304 can be filtered, either manually or possibly through the computer program 210, to confirm that the acquired signal indeed corresponds to the desired downhole event. Further, the rig noise 306 is predicted to have a signal frequency lower than 100 Hz. Thus, the signal 306 can be filtered and confirmed not to be associated with the downhole event and therefore disregarded.

The example used in FIGS. 3 and 4 should not be interpreted as limiting the present disclosure. For instance, a signal corresponding to a downhole event may be displayed individually on a single plot, or in combination with other signals on a single plot. Further, a signal may wholly or partially be displayed on one or more plots, without departing from the scope of the disclosure. If displayed on multiple plots, each plot is not required to be an exclusive data set of any other.

Figure 5:
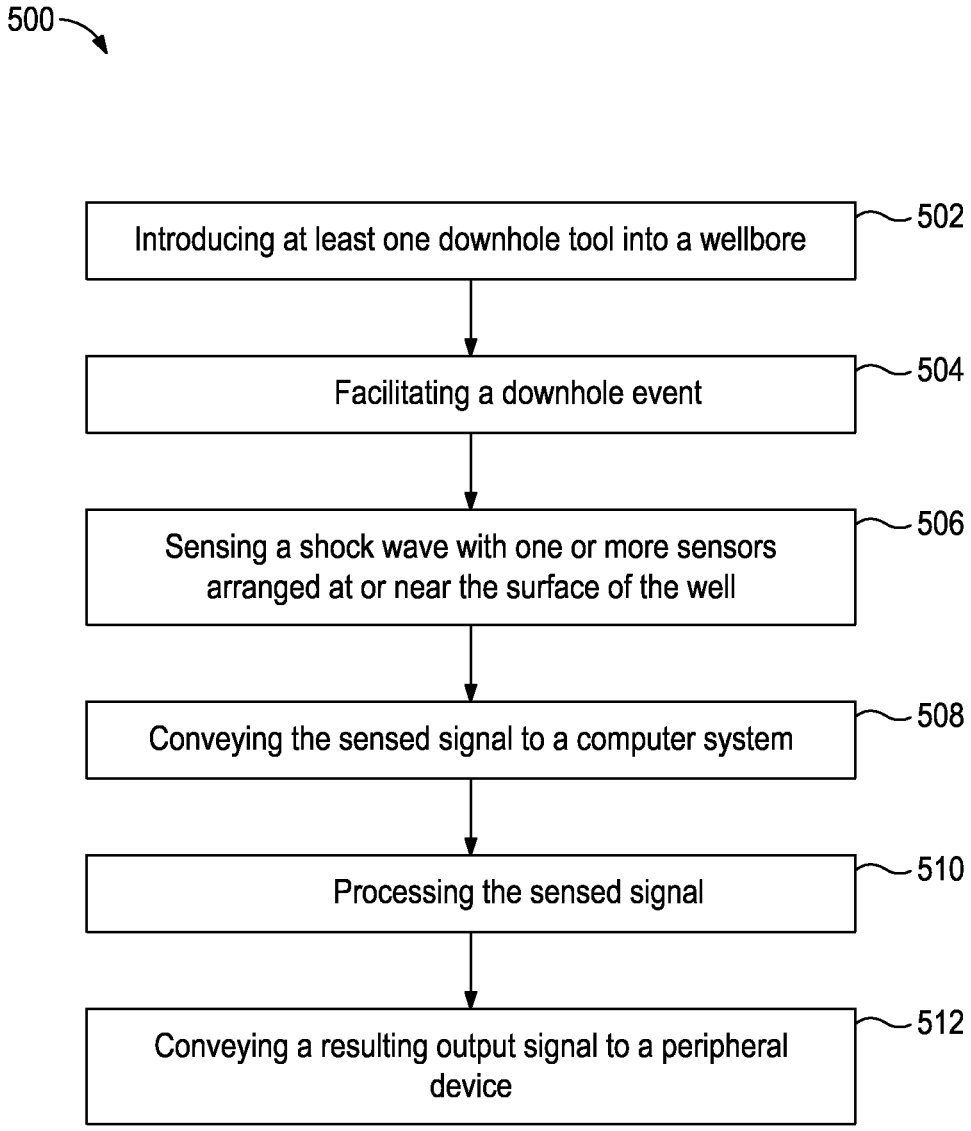
FIG. 5 illustrates a flow chart describing a method of observing downhole events through surface monitoring of vibrations, according to one or more embodiments.

Referring now to FIG. 5, illustrated is a schematic flow chart depicting an exemplary method 500 of observing downhole events through surface monitoring of vibrations, according to one or more embodiments. At 502, at least one downhole tool may be introduced into a wellbore on a work string. The wellbore may be of any type previously discussed above in the system 100 of FIG. 1, and the downhole tool may also be one similar to one or more of the downhole tools 120*a-c* described above, such as a sliding sleeve assembly, a shifting tool, a packer assembly, or a collet assembly.

The method 500 may then proceed by facilitating a downhole event, as at 504. The downhole event may refer to the actuation or operation of one of the downhole tools, or may also refer to a wellbore operation that has occurred downhole at or near one of the downhole tools. The downhole event may generate or otherwise emit a shock wave corresponding to the downhole event. The shockwave may be any vibration or frequency resonation capable of propagating up the wellbore, either through the work string or through the fluids present in the wellbore. The shock wave may be unique to the particular downhole tool that has been actuated or a particular wellbore operation that has transpired.

The method 500 may further include sensing the shock wave with one or more sensors arranged at or near the surface of the well, as at 506. Similar to sensors 122*a-f* in the system 100 of FIG. 1, the sensors may be any type of sensing device or apparatus configured to measure or quantify vibrations, including, but not limited to, accelerometers, strain gauges, pressure transducers, piezoelectric transducers, or the like. In some embodiments, the sensors may be placed above the earth's surface, such as on the rig, bails, Kelly, traveling block, or anywhere on the actual earth's surface. Further, the sensors may be placed below the earth's surface, such as being attached to the inner wall of the casing string.

The sensed signal may then be conveyed to a computer system, as at 508. The computer system may then be configured to process the sensed signal, as at 510. In some embodiments, processing the signal may include digitizing the sensed signal and pre or post-acquisition filtering of the signal. The computer system may also transform the acquired signal from the time domain into alternative domains, such as the frequency domain by using fast Fourier transforms, short-time Fourier transforms, wavelets, or the Goertzel algorithm. In another embodiment, the computer system may use the acquired data to compare and correlate actual work string length with expected work string length.

Processing the signal may further include querying a library or database containing data sets of pre-recorded or expected signals. The computer system may be configured to query such databases in order to match or substantially match the sensed signal with one of the pre-recorded or expected signals. Upon finding a match (or substantial match) to the sensed signal, a resulting output signal may be conveyed to a peripheral device, as at 512. The peripheral device may be a monitor display or a printer, for example, allowing a well operator to view a graphical output of the resulting output signal. In such embodiments, the resulting output signal may provide the user with a positive indication that a particular downhole event has occurred or whether a particular downhole tool as indeed actuated as planned.

Alternatively, the peripheral device may be an alarm (either audible or visual) to likewise provide the well operator with positive indication that particular downhole events have occurred or whether particular downhole tools have actuated as planned. In some embodiments, the peripheral device may be an external calibration system and the resulting output signal may be conveyed thereto in order to zero our or re-calibrate the length of the work string.

Computer hardware used to implement the various methods and algorithms described herein, such as the computer system 128, can include a processor configured to execute one or more sequences of instructions, programming stances, or code stored on a non-transitory computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), electrically erasable programmable read only memory (EEPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium refers to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A system, comprising:

a downhole tool arranged within a wellbore of a well and configured to undertake a downhole event that generates a unique shock wave associated to the downhole tool;

a sensor arranged at or near a surface of the well to sense the unique shock wave and generate a sensor signal in response to the unique shock wave; and a computer system that receives and processes the sensor signal and generates a resulting output signal corresponding to the downhole event.

2. The system of claim 1, wherein the downhole tool is selected from the group consisting of a sliding sleeve assembly, a shifting tool, a packer assembly or another type of wellbore isolation device, a collet assembly, a profiled wellbore device, and a wellbore projectile.

3. The system of claim 2, wherein the downhole event is at least one of a packer being set, shifters closing or opening a sliding sleeve, a collet snapping through a restriction, and a wellbore operation occurring downhole at or near the downhole tool.

4. The system of claim 1, wherein the unique shock wave propagates toward the surface of the well along a work string arranged within the wellbore.

5. The system of claim 1, wherein the unique shock wave is a pressure wave that propagates toward the surface of the well within fluids present within the wellbore.

6. The system of claim 1, wherein the sensor is selected from the group consisting of an accelerometer, a strain gauge, a pressure transducer, a piezoelectric transducer, and a piezo stack sensor.

7. The system of claim 1, wherein the sensor is arranged at or near the surface of the well on one of a top of a service rig, a component of service rig, a floor of the service rig, a wellhead installation, a portion of a work string arranged within the wellbore, an inner wall of a casing string lining the wellbore, and a riser.

8. The system of claim 1, wherein the computer system comprises a database containing data sets of pre-recorded or expected data signals corresponding to known downhole events undertaken by known downhole tools, the computer system being programmed to query the database to match or substantially match the resulting output signal with a pre-recorded or expected data signal and thereby provide positive indication of completion of the downhole event.

9. The system of claim 1, further comprising one or more peripheral devices configured to receive the resulting output signal.

10. The system of claim 9, wherein the one or more peripheral devices are selected from the group consisting of a monitor, a printer, an alarm, and storage memory.

11. A method, comprising:

introducing a downhole tool into a wellbore of a well;

undertaking a downhole event with the downhole tool and thereby generating a unique shock wave associated to the downhole tool and propagating within the wellbore;

sensing the unique shock wave with one or more sensors arranged at or near a surface of the well and thereby generating a sensor signal;

receiving and processing the sensor signal with the computer system and generating a resulting output signal corresponding to the sensor signal; and matching the resulting output signal with at least one pre-recorded or expected data signal corresponding to a known downhole event undertaken by a known downhole tool, and thereby providing positive indication of completion of the downhole event.

12. The method of claim 11, wherein the shock wave results from at least one of setting a packer, closing or opening a sliding sleeve, snapping a collet through a restriction, and landing a wellbore projectile.

13. The method of claim 11, wherein receiving and processing the sensor signal further comprises transforming the sensor signal from a time domain signal into a frequency domain signal.

14. The method of claim 13, wherein the sensor signal is transformed from the time domain signal into the frequency domain signal using at least one of fast Fourier transforms, short-time Fourier transforms, wavelets, and the Goertzel algorithm.

15. The method of claim 11, wherein the computer system processes the one or more sensor signals by applying at least one of a low-pass filter, a medium pass filter, and a high-pass filter.

16. The method of claim 11, wherein matching the resulting output signal with the at least one pre-recorded or expected data signal further comprises:

querying a database in the computer system containing data sets of pre-recorded or expected data signals corresponding to downhole event signals;

matching the resulting output signal to a pre-recorded or expected data signal; and conveying the resulting output signal to one or more peripheral devices.

17. The method of claim 11, further comprising conveying the resulting output signal to one or more peripheral devices.

18. The method of claim 17, wherein the one or more peripheral devices is an automated position data system, the method further comprising using the resulting output signal to calibrate the automated position data system.

19. The method of claim 11, further comprising modifying a design of the downhole tool to generate a predetermined unique shock wave upon undertaking the downhole event.

20. The method of claim 11, wherein sensing the unique shock wave with the one or more sensors comprises at least one of detecting the unique shock wave as it propagates along a work string arranged within the wellbore and detecting the unique shock wave as it propagates toward the surface of the well within fluids present within the wellbore.

* * * * *